US010227199B2

(12) United States Patent
Boland et al.

(10) Patent No.: US 10,227,199 B2
(45) Date of Patent: Mar. 12, 2019

(54) WEB HANDLING ROLLER WHEEL MECHANISM

(71) Applicants: Stuart James Boland, Denver, CO (US); Dilan Nirushan Fernando, Thornton, CO (US); Robert F. Jessen, Berthoud, CO (US)

(72) Inventors: Stuart James Boland, Denver, CO (US); Dilan Nirushan Fernando, Thornton, CO (US); Robert F. Jessen, Berthoud, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/341,684

(22) Filed: Nov. 2, 2016

(65) Prior Publication Data

US 2018/0117936 A1 May 3, 2018

(51) Int. Cl.

| | |
|---|---|
| ***B65H 23/34*** | (2006.01) |
| ***B41J 15/16*** | (2006.01) |
| ***B65H 23/32*** | (2006.01) |
| ***B65H 27/00*** | (2006.01) |

(52) U.S. Cl.

CPC ..... *B65H 23/34* (2013.01); *B41J 15/165* (2013.01); *B65H 23/32* (2013.01); *B65H 27/00* (2013.01); *B65H 2404/14211* (2013.01); *B65H 2601/254* (2013.01)

(58) Field of Classification Search

CPC .... B65H 23/34; B65H 23/048; B65H 23/192; B65H 27/00; B65H 2404/121; B65H 2404/1421; B65H 2404/1423; B65H 2404/1521; B65H 2404/1531; B65H 2404/1542; B65H 2404/1544; B65H 2404/652; B65H 2404/653; B65H 2404/654; B65H 2301/443; B65H 2301/4432; B65H 2301/44324; B65H 2301/443246; B65H 2301/51256; B65H 2301/512565; B65H 2301/5121; B65H 2404/14211; B41J 15/165

See application file for complete search history.

(56) References Cited

U.S. PATENT DOCUMENTS

| | | | |
|---|---|---|---|
| 1,996,277 | A | 4/1935 | Cross |
| 5,416,980 | A | 5/1995 | Ilvespaa |
| 5,870,662 | A | 2/1999 | Tomatsu |
| 6,427,825 | B1 | 8/2002 | Biagiotti |
| 6,898,410 | B2 | 5/2005 | Boss |
| 7,337,936 | B2 | 3/2008 | Ishida et al. |
| 8,249,480 | B2 | 8/2012 | Aslam et al. |
| 8,434,849 | B2 | 5/2013 | Kurasawa et al. |

(Continued)

FOREIGN PATENT DOCUMENTS

| | | |
|---|---|---|
| GB | 2242173 | 11/1989 |
| JP | 0272982 | 3/1990 |

(Continued)

*Primary Examiner* — Michael C McCullough

(74) *Attorney, Agent, or Firm* — Jaffery Watson; Mendonsa & Hamilton LLC

(57) ABSTRACT

A web handling system is disclosed. The web handling system includes a roller wheel including two or more rollers configured to engage a print medium, a motor to rotate the roller wheel and a controller to transmit a signal to the motor indicating which of the two or more rollers are to engage the print medium.

11 Claims, 5 Drawing Sheets

(56) References Cited

U.S. PATENT DOCUMENTS

| | | | | |
|---|---|---|---|---|
| 8,523,034 | B2 | 9/2013 | Fuchs et al. | |
| 9,020,412 | B2 * | 4/2015 | Osaki | G03G 15/6576 399/406 |
| 9,039,122 | B2 | 5/2015 | Walker et al. | |
| 9,075,379 | B2 * | 7/2015 | Egawa | G03G 15/6576 |
| 2012/0201590 | A1 | 8/2012 | Moore et al. | |
| 2015/0239181 | A1 * | 8/2015 | Corradini | B65H 23/0328 156/64 |
| 2016/0355029 | A1 * | 12/2016 | Kondo | B41J 11/0005 |
| 2017/0096017 | A1 * | 4/2017 | Fernando | B41J 11/0015 |
| 2017/0282601 | A1 | 10/2017 | Boland et al. | |

FOREIGN PATENT DOCUMENTS

| | | | |
|---|---|---|---|
| JP | 03007366 | A | 1/1991 |
| JP | 06227205 | | 2/1993 |
| JP | 4950593 | | 8/2006 |
| KR | 100148706 | | 10/1994 |
| WO | WO201514102 | | 2/2015 |

* cited by examiner 500
2
1
120

500
1
2
120

3
2
500

WEB HANDLING ROLLER WHEEL MECHANISM

FIELD OF THE INVENTION

The invention relates to the field of production printing systems, and in particular, to the handling of print media.

BACKGROUND

Entities with substantial printing demands typically implement a high-speed production printer for volume printing (e.g., one hundred pages per minute or more). Production printers include continuous-forms printers that print ink or toner on a web of print media stored on a large roll. An ink jet production printer typically includes a localized print controller that controls the overall operation of the printing system, and a print engine that includes one or more printhead assemblies, where each assembly includes a printhead controller and a printhead (or array of printheads). An individual ink jet printhead typically includes multiple tiny nozzles that discharge ink as controlled by the printhead controller. A printhead array is formed from multiple printheads that are spaced in series across the width of the web of print media.

While the ink jet printer prints, the web is quickly passed underneath the nozzles, which discharge ink onto the web at intervals to form pixels. A dryer, installed downstream from the printer, may assist in drying the wet ink on the web after the web leaves the printer. In an electrophotographic production printer, the imaged toner is fixed to the web with a high temperature fuser. Handling the web can prove challenging due to variation of a number of factors.

One such factor occurs when the printer stops printing. Rollers attain high temperature either directly from heaters or indirectly such as from contact with a heated web. The heat of the rollers may cause the media to curl when the web is stationary and wrapped around the roller for an extended time period. Thus, allowing a hot roller to maintain contact with the web increases the likelihood of curling. Moreover, different rollers (e.g. temperature, size, shape, profile, texture, or structure) may be needed for different printing conditions (e.g., media types, thickness, materials, processing requirements, etc.). Nonetheless, changing rollers is a slow process, which could affect efficiency of a printing system.

Accordingly, a mechanism to efficiently change web handling rollers in a printing system is desired.

SUMMARY

In one embodiment, a web handling system is disclosed. The web handling system includes a roller wheel including two or more rollers configured to engage a print medium, a motor to rotate the roller wheel and a controller to transmit a signal to the motor indicating which of the two or more rollers are to engage the print medium.

BRIEF DESCRIPTION OF THE DRAWINGS

A better understanding of the present invention can be obtained from the following detailed description in conjunction with the following drawings, in which.

DETAILED DESCRIPTION

A mechanism to efficiently change web handling rollers in a printing system is described. In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form to avoid obscuring the underlying principles of the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
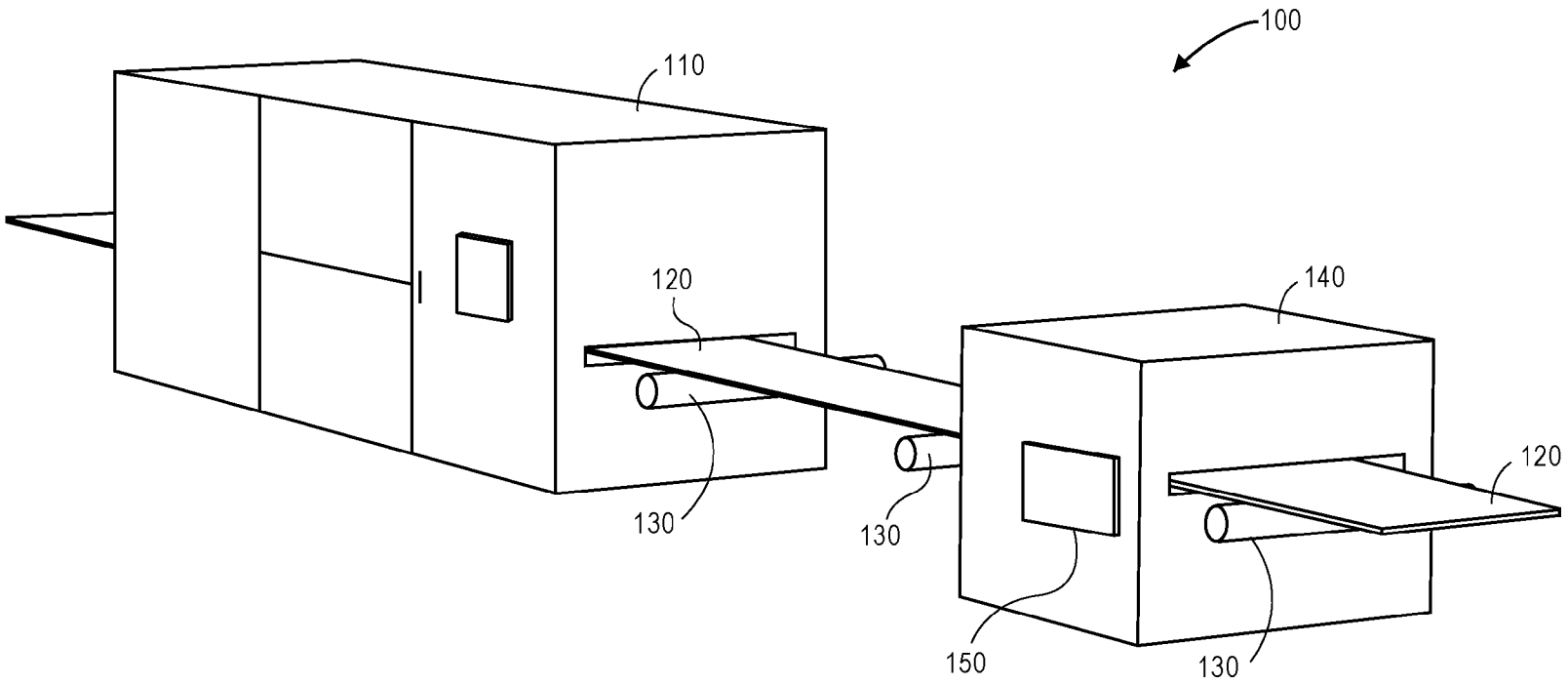
FIG. 1 illustrates one embodiment of a printing system.

FIG. 1 illustrates one embodiment of a printing system 100. Printing system 100 includes production printer 110, which is configured to apply ink onto a web 120 of continuous-form print media (e.g., paper). As used herein, the word "ink" is used to refer to any suitable marking material (e.g., aqueous based inks, solvent based inks, UV curable inks, clear inks, oil-based paints, toners, etc.). Printer 110 may include an inkjet printer that applies colored inks, such as Cyan (C), Magenta (M), Yellow (Y), Key (K) black, white, or clear inks. The ink applied by printer 110 to the web 120 is wet. Thus, the ink may smear if it is not dried before further processing. One or more rollers 130 position web 120 as it travels through, into or out of printing system 100.

To dry ink, printing system 100 also includes drying system 140 (e.g., a radiant heat dryer). In one embodiment, drying system 140 is an independent device downstream from printer 110. However, embodiments may feature drying system 140 being incorporated within printer 110. Web 120 travels through drying system 140 to dry the ink onto web 120. One or more rollers 130 position web 120 as it travels through, into or out of drying system 140.

Although discussed as a drying system, embodiments may feature implementation of system 140 as an independent web-handling device downstream from printer 110. Further embodiments may feature a web-handling system 140 being incorporated within printer 110. In such embodiments, web 120 travels through web handling system 140 to be buffered, tensioned, cooled, wound, unwound, aligned, cut, slit, punched or perforated.

Since rollers 130 maintain contact with the web 120 medium, the rollers 130 may themselves become exceedingly hot, potentially resulting in the likelihood of curling of the web 120 medium when web 120 stops. According to one embodiment, rollers 130 comprise a roller wheel configuration of two or more rollers to enable disengagement of a first (e.g., hot) roller from web 120 to reduce likelihood of curling. In such an embodiment, a second (e.g., cool) roller subsequently engages web 120 in order to continue operation.

In a further embodiment, web handling system 140 includes a controller 150 to facilitate the changing from the first roller to the second roller upon detecting that web 120 has stopped, thus preventing the hot roller from maintaining contact with the stopped web 120. Controller 150 may initiate a roller change upon receiving input from one or more sensors or other devices (e.g. the printer 110) operable within printing system 100, or user input from a graphical user interface (GUI). Sensors within the web handling system 140 may include rotary encoders, presence, position, velocity, acceleration or temperature type sensors. Further, the GUI may provide an operator with system control and status. Control may be linked to printing system configuration snapshots for further automation. In other embodiments, controller 150 may be located outside of web handling system 140.

In still a further embodiment, controller 150 transmits an output signal to a motor coupled to the wheel 130 in order to trigger the roller change. The motor may be directly or indirectly coupled to the axis of roller wheel 130 and/or have a included or external driver to receive the controller signal. In some embodiments, the rollers may have different dimensions, sizes, shapes, profiles, textures and/or material to facilitate operation under different printing conditions (e.g., media types, thickness, materials, processing requirements, etc.). Thus, controller 150 may facilitate the changing from the first roller to the second roller upon detecting that the printing conditions are to change.

In one embodiment, the roller wheel is held stationary unless rollers are being selected. In other embodiments, one or more latches may be included on the roller to secure rollers to the wheel. Further, the latches enable each roller to be removed individually and replaced as needed when that roller is not engaged with web. In other embodiments a lever may be placed on the roller wheel to provide an operator with the ability to manually rotate the wheel.

FIGS. 2A-2I illustrate embodiments of a roller wheel 200 having rollers 220(*a*) and 220(*b*) coupled via a pivot arm 210 (e.g., a wheel spoke). As shown in FIGS. 2A-2D, roller wheel 200 rotates around pivot arm 210 to disengage roller 220(*a*) from web 120 and subsequently engage roller 220(*b*). In another embodiment, the axis of roller wheel 200 is substantially parallel with the axes of rollers 220(*a*) and 220(*b*). As discussed above, controller 150 may facilitate the roller change upon detecting that web 120 has stopped. However in other embodiments, controller 150 may facilitate the roller change while web 120 is moving. In one embodiment, roller wheel 200 and rollers 220 may rotate in either direction.

FIGS. 2E-2I illustrate other embodiments of roller wheel 200 having thermal isolation between rollers in order to minimize the temperature of one roller (e.g., 220(*a*)) from affecting the other roller (e.g., 220(*b*)) due to radiant energy transfer. Thermal isolation may include a reflector and/or insulator. In one embodiment, reflectors are constructed of thermally reflective materials with straight and/or curved profiles.

In such embodiments, the reflectors are placed between at least two rollers (e.g., attached to pivot arm 210) and extends substantially the length of the rollers. Further, the reflectors are kept within the confines of wheel 200 engagement of web 120 during all rotations so as to not to not interfere with web 120. Insulators are comprised of a thermally insulated material and may optionally be placed between reflectors.

Figure 2A:
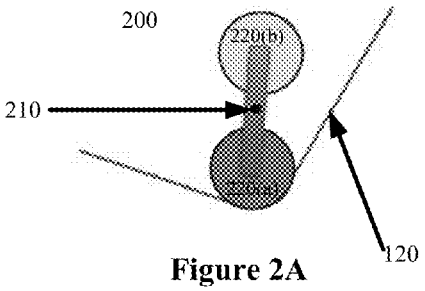
FIGS. 2A-2I illustrate embodiments of a roller wheel.
Figure 2B:
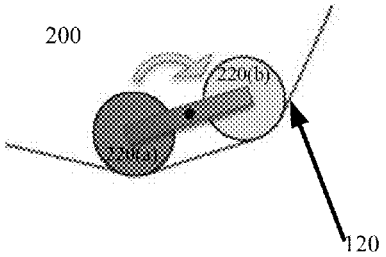
Figure 2C:
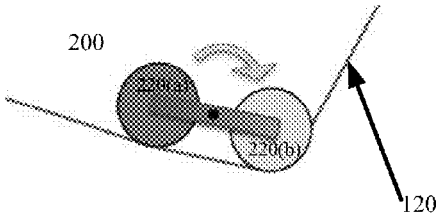
Figure 2D:
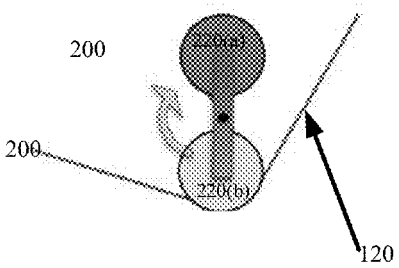
Figure 2F:
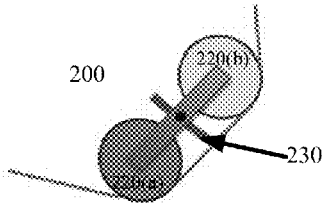
Figure 2G:
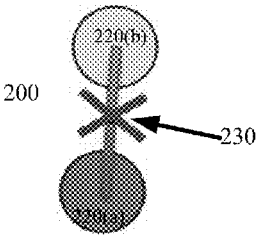
Figure 2H:
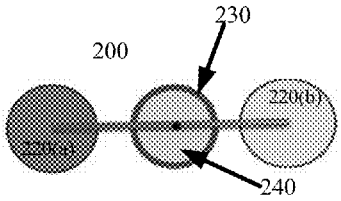
Figure 2I:
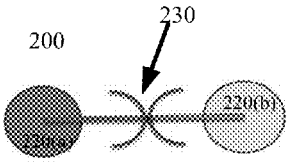
Figure 2E:
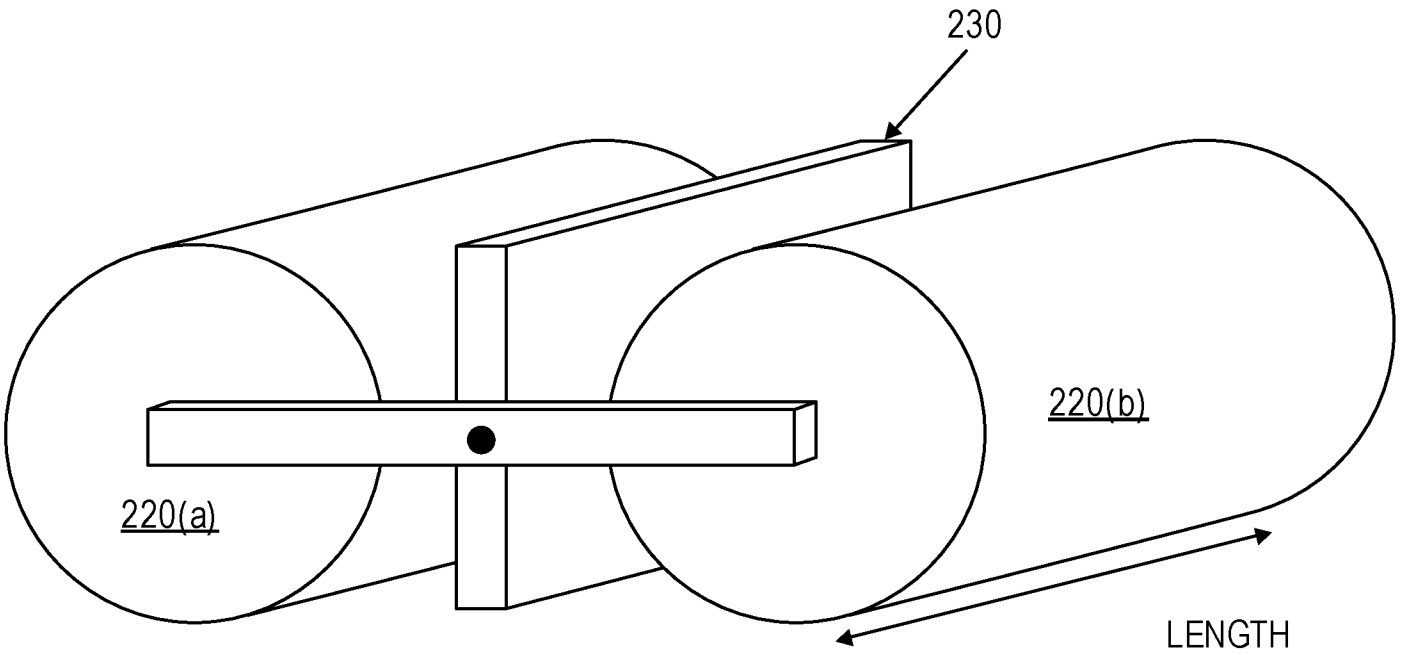

FIGS. 2E & 2F illustrate an embodiment of a straight reflector 230 proportioned and positioned to avoid contact with web 120. FIG. 2E illustrates one embodiment of an isometric view of the roller wheel assembly having a reflector 230. As shown in FIG. 2E, reflector 230 extends substantially the length of rollers 220. FIG. 2G illustrates an embodiment of a several straight reflectors 230. FIG. 2H illustrates an embodiment of a curved reflector 230 with insulation 240 inside or between the reflector 230 surfaces. FIG. 2I illustrates an embodiment of a curved reflector. In some embodiments, cooling air from pressurized nozzles (not shown) may be directed at one or more rollers 220 that are positioned away from web 120 to provide convection cooling.

Figure 3A:
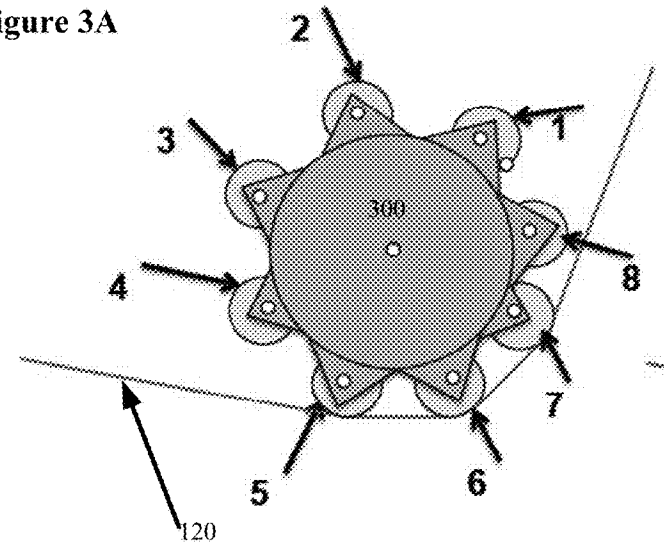
FIGS. 3A and 3B illustrate other embodiments of a roller wheel.
Figure 3B:
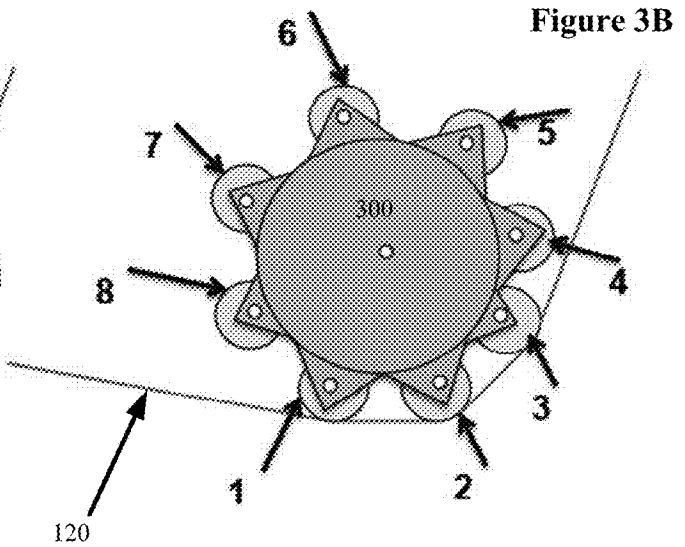

FIGS. 3A and 3B illustrate another embodiment in which a roller wheel 300 includes rollers 1-8 mounted about the hub of roller wheel 300. In such an embodiment, wheel 300 rotates to disengage some rollers from web 120 and engage different rollers. FIG. 3A shows a start position in which rollers 5-8 are engaged with web 120, while rollers 1-4 are disengaged. FIG. 3B shows a new position in which rollers 1-4 are engaged with web 120 and rollers 5-8 are disengaged (e.g., after controller 150 facilitation).

Figure 4A:
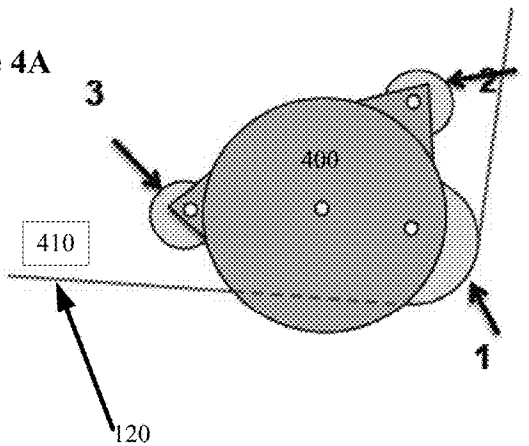
FIGS. 4A and 4B illustrate further embodiments of a roller wheel.
Figure 4B:
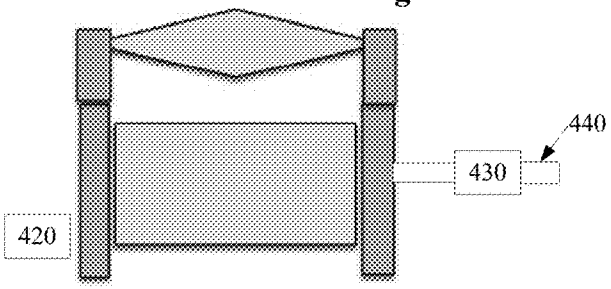

As discussed above, rollers may have different sizes to enable operation under different print conditions. FIGS. 4A and 4B illustrate such an embodiment in which a roller wheel 400 includes rollers 1, 2 and 3. In this embodiment, rollers 2 and 3 have similar dimensions, while roller 1 is larger. FIG. 4A illustrates an end view of roller wheel 400 having a web sensor 410 that monitors the speed of web 120. FIG. 4B shows a side view of wheel 400 without web 120. As shown in FIG. 4B, roller 2 has a slanted profile suitable for spreading a media web while roller 1 has a flat parallel profile. Further, FIG. 4B shows a wheel sensor 420 that monitors the rotational position of wheel 400, and a motor 430 coupled to rotate wheel 400 under control of a driver 440.

Figures 5A, 5B, 5C:
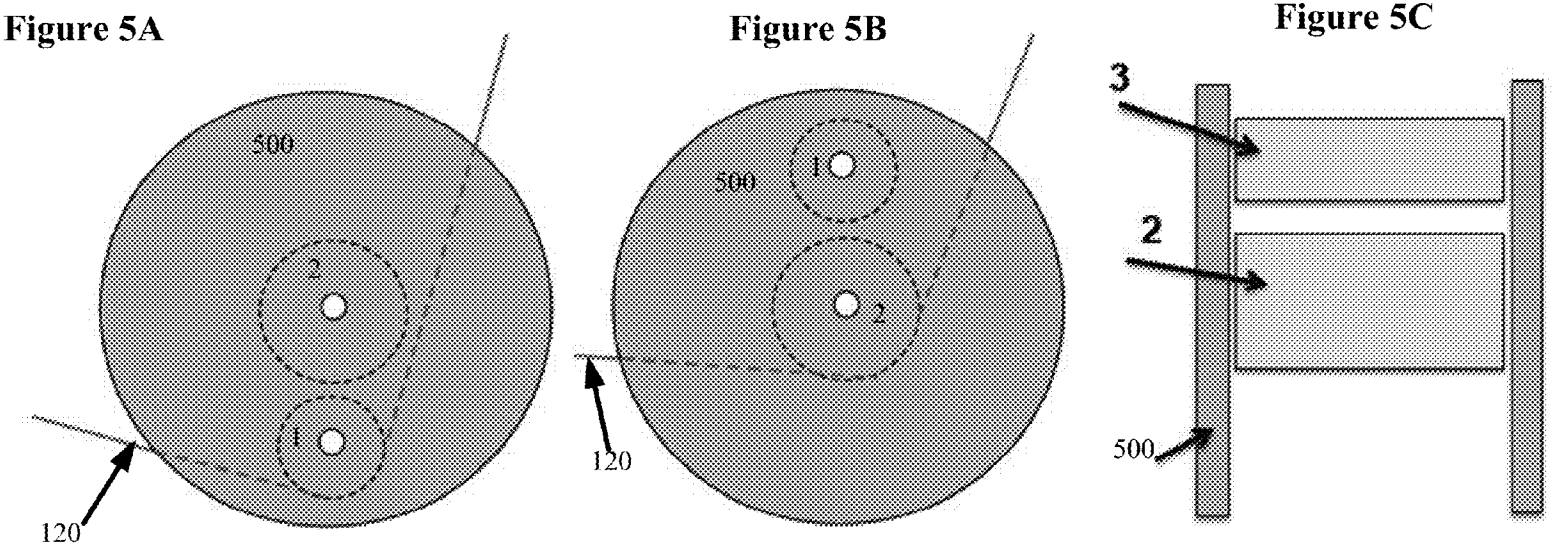
FIGS. 5A-5C illustrate additional embodiments of a roller wheel.

FIGS. 5A-5C illustrate yet another embodiment in which of a roller wheel 500 includes rollers 1 and 2 mounted within. In this embodiment, roller 2 is mounted on the axis of wheel 500, while roller 1 is mounted on the hub. By rotating wheel 500, either roller 1 or 2 are engaged with web 120. FIG. 5A illustrates an end view of roller wheel 500 in which roller 1 is engaging web 120, while FIG. 5B shows an end view in which roller 2 is engaging web 120. FIG. 5C shows a side view of wheel 500 without web 120.

The above-described roller wheel reduces web media curl during system stoppages with minimal or no operator involvement and no media web waste. Moreover, although described above with regards to implementation in a web handling system, the roller wheel may be implemented in other web handling applications. For instance, the roller wheel may be applied to any industry that implements web handling (e.g., paper manufacture, paper converting, textile processing, non-paper (e.g., polyester web processing, etc.).

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims, which in themselves recite only those features regarded as essential to the invention.

What is claimed is:

1. A web handling system, comprising:

a roller wheel including:

rollers configured to engage a print medium, having:

a first roller; and a second roller; and one or more reflectors coupled between the first roller and the second roller;

a motor to rotate the roller wheel; and a controller to transmit a signal to the motor indicating which of the rollers are to engage the print medium, wherein the roller wheel rotates upon the motor receiving a signal from the controller indicating that the first roller engaging the print medium is to disengage the print medium and the second roller is to engage the print medium.

2. The system of claim 1, further comprising a sensor coupled to the controller to detect movement of the print medium, wherein the controller transmits the signal upon a detection that the print medium has stopped moving.

3. The system of claim 1, further comprising a sensor coupled to the controller to detect movement of the print medium, wherein the controller transmits the signal upon a detection that conditions at the print system have changed while the print medium is moving.

4. A roller wheel system comprising:

a first roller engaged with a print medium;

a second roller disengaged from the print medium, wherein the first roller disengages the print medium and the second roller engages the print medium upon receiving a signal from a controller;

a pivot arm coupled between the first roller and the second roller; and one or more reflectors coupled to the pivot arm.

5. The system of claim 4, wherein the one or more reflectors comprise one or more straight reflectors.

6. The system of claim 5, further comprising insulation inserted within the one or more reflectors.

7. The system of claim 4, wherein the one or more reflectors comprise a curved reflector.

8. A roller wheel system, comprising:

a first roller mounted within the roller wheel to engage with the print medium;

a second roller mounted within the roller wheel to disengage from the print medium; and a roller wheel axis configured to be rotated by a motor that receives a signal from a controller, wherein the roller wheel rotates upon the motor receiving a signal from the controller indicating that the first roller engaging the print medium is to disengage the print medium and the second roller is to engage the print medium.

9. The system of claim 8, wherein the first roller is mounted on an axis of the roller wheel and the second roller is mounted on a hub of the roller wheel.

10. The system of claim 9, wherein the first roller has a first size dimension and the second roller has a second size dimension.

11. The system of claim 8, wherein the first roller has a first size dimension and the second roller has a second size dimension.

* * * * *